US010342107B2

(12) United States Patent
Matilaine

(10) Patent No.: US 10,342,107 B2
(45) Date of Patent: Jul. 2, 2019

(54) CASCADED FILAMENT TRANSFORMER WITHIN A RESISTIVE SHROUD

(71) Applicant: KIMTRON, INC., Oxford, CT (US)

(72) Inventor: John Matilaine, Armonk, NY (US)

(73) Assignee: KIMTRON, INC., Oxford, CT (US)

( * ) Notice: Subject to any disclaimer, the term of this patent is extended or adjusted under 35 U.S.C. 154(b) by 17 days.

(21) Appl. No.: 15/350,416

(22) Filed: Nov. 14, 2016

(65) Prior Publication Data

US 2017/0303378 A1 Oct. 19, 2017

Related U.S. Application Data

(60) Provisional application No. 62/254,376, filed on Nov. 12, 2015.

(51) Int. Cl.

| | |
|---|---|
| ***H05G 1/32*** | (2006.01) |
| ***H01F 17/06*** | (2006.01) |
| ***H01F 27/24*** | (2006.01) |
| ***H01F 27/29*** | (2006.01) |
| ***H01F 27/28*** | (2006.01) |
| ***H01F 27/32*** | (2006.01) |
| ***H01F 27/40*** | (2006.01) |

(Continued)

(52) U.S. Cl.

CPC ..... *H05G 1/32* (2013.01); *H01F 17/062* (2013.01); *H01F 27/24* (2013.01); *H01F 27/2823* (2013.01); *H01F 27/29* (2013.01); *H01F 27/324* (2013.01); *H01F 27/40* (2013.01); *H01F 27/42* (2013.01); *H01F 38/16* (2013.01); *H05G 1/10* (2013.01)

(58) Field of Classification Search

CPC ..... H05G 1/32
USPC ..... 307/151
See application file for complete search history.

(56) References Cited

U.S. PATENT DOCUMENTS

| | | | |
|---|---|---|---|
| 2,490,140 | A | 4/1946 | Ledeboer |
| 2,512,193 | A | 6/1950 | Zavales |

(Continued)

FOREIGN PATENT DOCUMENTS

| | | |
|---|---|---|
| CN | 204259267 | 8/2015 |
| DE | 3721591 | 1/1989 |

(Continued)

OTHER PUBLICATIONS

Charlton, E. E., et al. "An Oil-immersed X-ray Outfit for 500,000 Volts and an Oil-immersed Multi-section X-ray Tube." Radiology, vol. 29, Issue 3 (Sep. 1937), p. 329. http://pubs.rsna.org/doi/pdf/10.1148/29.3.329.

(Continued)

*Primary Examiner* — Adi Amrany
(74) *Attorney, Agent, or Firm* — Ware, Fressola, Maguire & Barber LLP

(57) ABSTRACT

An apparatus is provided including a cascaded transformer set and a voltage divider. The cascaded transformer set includes a plurality of transformers, each having a primary and a secondary winding. The secondary winding of one transformer feeds the primary winding of an adjacent transformer. The voltage divider includes a plurality of capacitors and a plurality of resistors configured to divide a voltage applied to the cascaded transformer set among the plurality of transformers. The capacitors of the voltage divider may include a series of disks that are also used in the support structure of the apparatus.

18 Claims, 3 Drawing Sheets

(51) Int. Cl.

| | |
|---|---|
| ***H01F 27/42*** | (2006.01) |
| ***H01F 38/16*** | (2006.01) |
| ***H05G 1/10*** | (2006.01) |

(56) References Cited

U.S. PATENT DOCUMENTS

| | | | | |
|---|---|---|---|---|
| 3,183,357 | A | 5/1965 | Phelan et al. | |
| 4,188,536 | A | 2/1980 | DallaPiazza | |
| 4,189,739 | A * | 2/1980 | Copeland, III | H01L 27/0255 257/363 |
| 4,311,913 | A | 1/1982 | Resnick et al. | |
| 4,571,667 | A | 2/1986 | Csorsz | |
| 4,590,603 | A | 5/1986 | Relihan et al. | |
| 4,603,310 | A * | 7/1986 | Yarman | H03H 7/20 327/231 |
| 4,646,338 | A | 2/1987 | Skillicom | |
| 5,079,687 | A | 1/1992 | Sakisaka et al. | |
| 5,231,564 | A * | 7/1993 | Pellegrino | H02M 7/103 363/61 |
| 5,335,161 | A * | 8/1994 | Pellegrino | H02M 7/106 363/61 |
| 5,602,897 | A | 2/1997 | Kociecki et al. | |
| 5,727,043 | A | 3/1998 | Watanabe | |
| 5,966,425 | A * | 10/1999 | Beland | H02M 7/1557 378/108 |
| 6,281,762 | B1 * | 8/2001 | Nakao | H03K 17/687 327/308 |
| 6,563,717 | B2 | 5/2003 | Lunding et al. | |
| 6,885,728 | B2 | 4/2005 | Hadland et al. | |
| 6,927,985 | B2 | 8/2005 | Klinkowstein | |
| 7,050,539 | B2 | 5/2006 | Loef et al. | |
| 7,366,283 | B2 | 4/2008 | Carlson et al. | |
| 7,448,802 | B2 | 11/2008 | Oettinger et al. | |
| 7,639,784 | B2 | 12/2009 | Feda | |
| 7,672,432 | B2 | 3/2010 | Bosello | |
| 7,787,593 | B2 | 8/2010 | Klein | |
| 7,852,986 | B2 | 12/2010 | Loef et al. | |
| 7,949,099 | B2 | 5/2011 | Klinkowstein et al. | |
| 8,487,534 | B2 | 7/2013 | Caiafa et al. | |
| 8,675,378 | B2 | 3/2014 | Beland | |
| 8,964,940 | B2 | 2/2015 | Caruso et al. | |
| 9,048,059 | B2 | 6/2015 | Jeong et al. | |
| 2011/0002446 | A1 * | 1/2011 | Beland | H05G 1/10 378/111 |

FOREIGN PATENT DOCUMENTS

| | | |
|---|---|---|
| EP | 0146225 | 6/1985 |
| EP | 0228648 | 4/1998 |
| GB | 242946 | 1/1926 |
| GB | 1321896 | 7/1973 |
| GB | 2517671 | 4/2015 |
| JP | 2003257697 | 9/2003 |
| JP | 2010040809 | 2/2010 |
| KR | 101552318 | 9/2015 |

OTHER PUBLICATIONS

Hendricks, R. W. Abstract of "The ORNL 10-meter small angle X-ray scattering camera." Journal of Applied Crystallography, vol. 11, Issue 1 (1978), pp. 15-30. http://scripts.iucr.org/cgi-bin/paper?a16722.

Dumond, Jesse WM, and J. Paul Youtz, "The Thirty Kilowatt Continuous Input X-Ray Equipment and High Constant Voltage Generating Plant of the Watters Memorial Research Laboratory at the California Institute of Technology." Review of Scientific Instruments 8 (1937), pp. 291-307. http://authors.library.caltech.edu/46456/1/1.1752317.pdf.

Schardt, Peter, et al., "New x-ray tube performance in computed tomography by introducing the rotating envelope tube technology." Medical Physics, vol. 31, Issue 9 (Sep. 2004), pp. 2699-2706. http://faculty.kfupm.edu.sa/PHYS/halsadah/Schardt2004_RotatingVesselXray Tube.pdf.

Rajwade, J., "Emission Control System for an X-ray Tube," Aug. 2001 (111 pages) http://academic.csuohio.edu/embedded/Publications/Thesis/JaisinghThesis.pdf.

Spellman High Voltage Electronics Corporation, "X-ray Generators & Monoblock X-ray Sources," Product Specifier, Nov. 2015 (4 pages) http://www.tminstruments.com.br/imagens/tm2/831.pdf.

Spellman High Voltage Electronics Corporation, "uX 50W/65W/75W X-ray Generator," 2014 (5 pages) http://www.spellmanhv.com/sitecore modules/web/~/media/Files/Products/uX.ashx.

* cited by examiner

CASCADED FILAMENT TRANSFORMER WITHIN A RESISTIVE SHROUD

CROSS-REFERENCE TO RELATED APPLICATIONS

The present application claims the benefit of U.S. Provisional Patent Application No. 62/254,376, filed Nov. 12, 2015, which is incorporated by reference in its entirety.

FIELD OF THE INVENTION

The present invention relates to a cascaded filament transformer within a resistive shroud, particularly for use with X-ray tube filaments.

BACKGROUND OF THE INVENTION

X-ray tubes require a source of power to a filament in order to produce the electrons which will be accelerated to produce X-rays. In most X-ray tubes, the filament is part of the cathode structure of the tube, which is several to many tens of kilovolts (kV) negative in potential with respect to ground potential. Because control electronics and the prime power source are generally located at ground potential, a means of delivering power on the order of tens of watts across this potential barrier is needed.

Historically, this means of delivering power consists of some sort of transformer whose primary winding is at ground potential and whose secondary winding is sufficiently insulated to withstand the cathode high voltage potential reliably even in the face of arcing either in the X-ray tube, or in the high voltage power generator itself, or in the cable connecting them. A safe and reliable means of constructing such a transformer involves winding a primary around one leg of a four sided core. The secondary winding is generally contained within a circular tube concentric with the primary winding. The opening in the core through which the windings are wound is called the window.

To maintain reliable isolation, such a transformer must have large separations between the secondary and primary windings. This requires a very large window, and by extension, a very large core. The size of the transformer can be reduced by operating it in an insulating medium, such as oil, pressurized gas, or a solid potting material. However, the size of the transformer is still quite large for typical operating voltages of 100 to 250 kV. Attempts to reduce the size of such a transformer inevitably reduce the insulation reliability since the entire voltage is "held off" by one insulating space.

SUMMARY OF THE INVENTION

The present invention solves the aforementioned problems in the art by providing a cascaded transformer device. The cascaded transformer dramatically reduces the size of the transformer delivering power to the X-ray tube filament by dividing the voltage among multiple insulating spaces. In the cascaded transformer of the present invention, several identical transformers are "stacked up" to form a set of transformers, with the secondary winding of one transformer feeding the primary winding of the next or adjacent transformer. In one embodiment of the invention, a series of eight coils and capacitive plates are used, which requires no potting or paper wrapping and provides superior arc resistance.

Each individual transformer in the transformer set sees only a fraction of the main voltage and can thus be made many times smaller, as compared to a transformer receiving the entire voltage. In accordance with a preferred embodiment of the present invention, each transformer is a one to one ferrite toroid with a three turn primary winding and a three turn secondary winding. The primary and secondary windings are wound on opposite sides of the toroids to maintain physical separation and are wound with high voltage insulated wire. There are thus three insulating gaps in each transformer: (1) the primary wire insulation, (2) the physical separation between the windings, and (3) the secondary wire insulation. The ferrite core is a non-conductor, so it does not bridge the physical gap between the windings. The core size and number of turns per winding are preferably chosen for an operating frequency of 20 kHz to 30 kHz. The wire gauge is preferably chosen to be more than adequate for the maximum operating current needed to energize the X-ray tube filament.

In accordance with the present invention, the transformer set includes a plurality of transformers, and in a preferred embodiment, four transformers are included in the transformer set. As a result, with four transformers in the transformer set, each having three insulating gaps, the total voltage is spread out over twelve insulating gaps.

The cascaded transformer apparatus of the present invention also comprises means to insure the total voltage is predictably and evenly spread out over the insulating gaps, even in the face of high voltage arcing outside the transformer. This can be accomplished using a "Compensated Voltage Divider".

A compensated voltage divider utilizes a ladder arrangement of equal value resistors and capacitors. The resistors fulfill the dividing function for direct current and low frequencies, while the capacitors do the same for high frequencies. The compensated voltage divider of the present invention is not actually composed of discrete resistors and capacitors, but utilizes the supporting structure of the cascade to fulfill the same function.

The cascaded filament transformer can be in the form of a vertical stack. In an embodiment where the transformers are toroids, the toroids are arranged one on top of each other, and the toroids are mounted horizontally with conducting discs whose diameter is somewhat larger than the diameter of the toroids inserted between them. There are five of these conducting discs, with four toroids sandwiched between pairs of the conducting discs. When placed in an oil insulating medium, the oil between the discs, which can be made of aluminum or another conducting material, comprises the resistive part of the divider, while the space between the discs and the discs themselves comprise the capacitive part of the divider. The windings also have some small amount of stray capacitance to themselves and to the discs which is in parallel with the main capacitance between the discs. The oil, while generally thought of as an insulator, has a very high distributed resistance. The device includes four stages, which include a toroid between two conducting discs in the insulating medium. Because the geometry of each of the four stages is identical, the capacitances and resistances of each stage are virtually identical. This fulfills the requirement for a compensated divider.

Such a structure free standing in oil would be subject to external disrupting influences which could compromise the insulation integrity. To avoid this possibility, the structure is enclosed within a nylon or other plastic cylinder or tube with thick walls. This tube also has a very high distributed resistance and thus is in parallel with the oil resistance inside the tube, aiding in its low frequency and direct current dividing function. Its thickness shields the internal structure from external fields, greatly adding to the insulation reliability.

In accordance with an aspect of the present invention, an apparatus may be provided. The apparatus comprises a cascaded transformer set comprising a plurality of transformers, each having a primary and a secondary winding. In the cascaded transformer set, the secondary winding of one transformer feeds the primary winding of an adjacent transformer. The apparatus may further comprise a voltage divider comprising a plurality of capacitors and a plurality of resistors configured to divide a voltage applied to the cascaded transformer set among the plurality of transformers.

In accordance with an embodiment of the apparatus of the invention, the plurality of capacitors may comprise a plurality of discs. The plurality of discs and plurality of transformers are arranged such that each of the plurality of transformers is positioned between two of the plurality of discs.

In accordance with one embodiment of the apparatus, the plurality of transformers comprises four transformers and the plurality of discs comprises five discs. In a further embodiment, each transformer of the plurality of transformers is a toroidal transformer comprising a ferrite core with the primary windings and secondary windings around opposing sides of the ferrite core. The primary and secondary winding of each of the plurality of transformers may be a three turn winding around the ferrite core. The primary winding and the secondary winding of each of the plurality of transformers may further comprise a high voltage insulated wire.

In accordance with a further embodiment of the apparatus of the present invention, the plurality of transformers and the plurality of discs are arranged parallel to each other in a stack, wherein the stack alternates between one of the plurality of discs and one of the plurality of transformers, such that each of the plurality of transformers is positioned in between two of the plurality of discs.

In accordance with a further embodiment of the apparatus of the present invention, the cascaded transformer set is configured to be connected to an input drive at a first end and a filament output drive and a common terminal at second end opposing the first end. The input drive may be connected to a primary winding of a first transformer, a secondary winding of the first transformer may feed into a primary winding of a second transformer, a secondary winding of the second transformer may feed into a primary winding of a third transformer, a secondary winding of the third transformer may feed into a primary winding of a fourth transformer, and the fourth transformer may be connected to the filament output drive and the common terminal.

In accordance with a further embodiment of the apparatus of the present invention, the apparatus may comprise a resistive shroud around the cascaded transformer set and the plurality of discs, wherein the resistive shroud forms at least a part of the plurality of resistors of the voltage divider. In certain embodiments, the resistive shroud is a nylon tube around the cascaded transformer set and the plurality of discs.

In accordance with a further embodiment of the apparatus of the present invention, the apparatus further comprises an oil medium surrounding the plurality of transformers and the plurality of discs. The resistive shroud and the oil medium may provide the plurality of resistors of the voltage divider.

In accordance with a further embodiment of the apparatus of the present invention, each of the plurality of transformers comprises three insulating gaps in the form of insulation of the high voltage insulated wire of the primary winding, insulation of the high voltage insulated wire of the secondary winding and a physical space between the primary winding and secondary winding.

In accordance with a further embodiment of the apparatus of the present invention, the apparatus is configured for providing power to an X-ray tube filament.

In accordance with a further embodiment of the apparatus of the present invention, each of the plurality of discs is made from aluminum.

In accordance with a further embodiment of the apparatus of the present invention, the apparatus further comprises an oil medium surrounding the plurality of transformers and the plurality of discs.

DETAILED DESCRIPTION OF THE FIGURES

Figure 1:
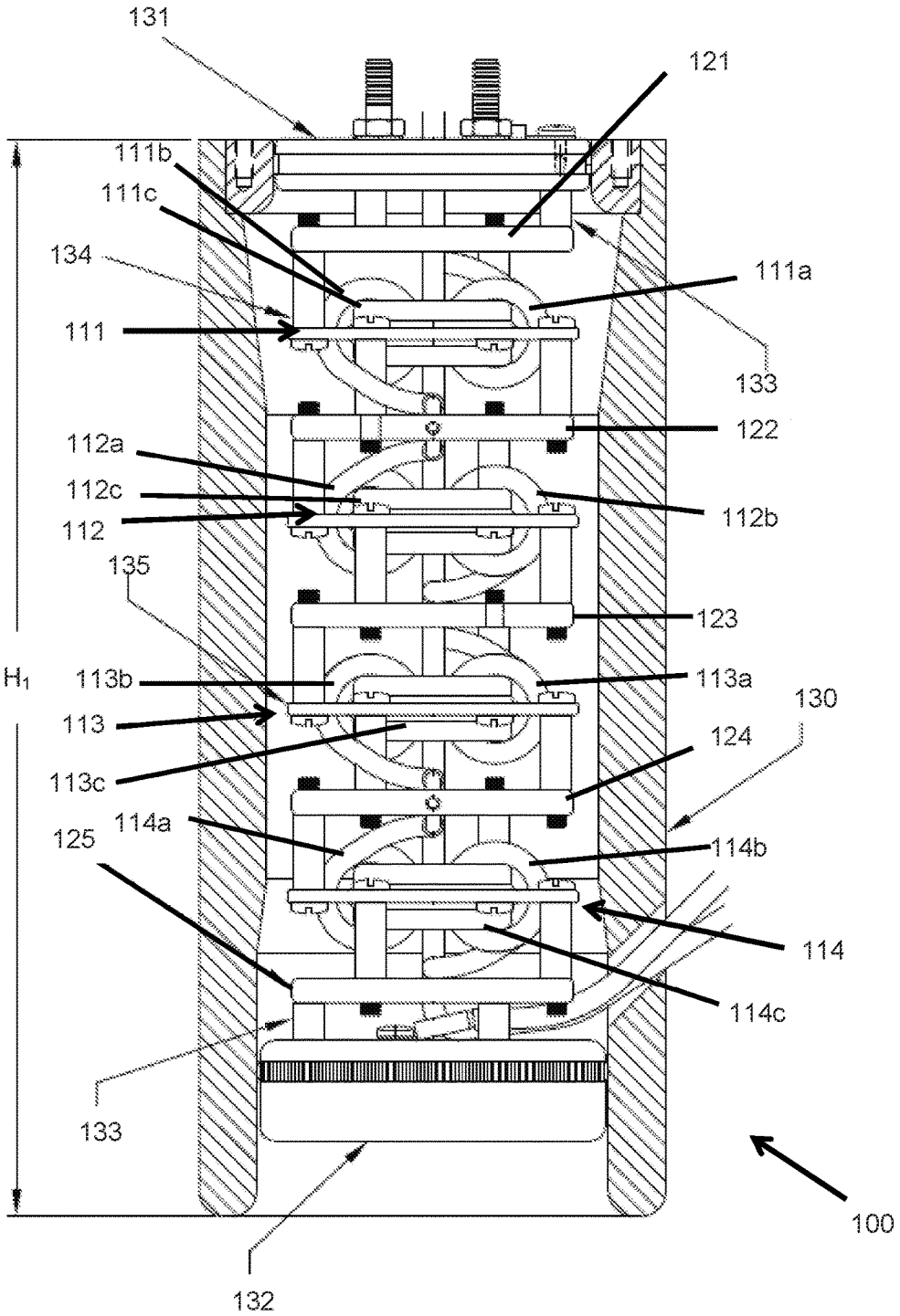
FIG. 1 shows a cross-sectional view of an embodiment of the cascaded transformer apparatus of the present invention including a resistive shroud.

The present invention will now be described with reference made to FIGS. 1-3.

As shown in the Figures, a cascaded transformer apparatus 100 is provided. The cascaded transformer apparatus 100 can be used, for example, to provide electric current to an X-ray tube filament of an X-ray device. The cascaded transformer apparatus 100 comprises a transformer set 110 of individual transformers 111, 112, 113, 114 in a cascade and a compensated voltage divider 120.

Each of the transformers 111, 112, 113, 114 in the cascaded transformer set 110 is configured in the same manner. In a preferred embodiment, the transformers 111, 112, 113, 114 each are one to one ferrite toroids with three turn primary windings 111*a*, 112*a*, 113*a*, 114*a* and three turn secondary windings 111*b*, 112*b*, 113*b*, 114*b*. The windings are wound on opposite sides of the toroids, which maintains physical separation between the primary and secondary windings. The wires of the primary and secondary windings of the transformers 111, 112, 113, 114 comprise an insulation layer surrounding the wires. In a preferred embodiment, the insulation of the wires provides an insulation of 40 kV.

Each transformer 111, 112, 113, 114 includes three insulating gaps: the insulation of the primary winding wire, the insulation of the secondary winding wire and the physical separation between the windings. Each transformer 111, 112, 113, 114 also includes a ferrite core 111*c*, 112*c*, 113*c*, 114*c*, around which the windings are placed. The ferrite core 111*c*, 112*c*, 113*c*, 114*c* is a non-conductor, and as a result, it does not bridge the physical gap between the windings. The core size and number of turns per winding are chosen for an operating frequency of 20 kHz to 30 kHz. The wire gauge of the wires of the windings is chosen to be more than adequate for the maximum operating current of the filament to be energized. Although the transformers 111, 112, 113, 114 may be toroids as described above, in alternative embodiments of the invention, different types or structures of transformers may be included in the cascaded transformer set 110 without departing from the scope of the invention.

In a preferred embodiment of the cascaded transformer apparatus 100, four transformers 111, 112, 113, 114 are used. Because each transformer 111, 112, 113, 114 includes three insulating gaps, the total voltage is spread out over twelve insulating gaps. However, the present invention is not limited to embodiments comprising four transformers, but in alternative embodiments, different numbers of transformers may be included in the apparatus 100 without departing from the scope of the invention.

The apparatus 100 further comprises a compensated voltage divider 120, to insure that the voltage is predictably and evenly spread out over the insulating gaps of the transformer set 110, even in the face of high voltage arcing outside the transformer. The compensated voltage divider 120 utilizes a ladder arrangement of equal value resistors R1-R11 and equal value capacitors C1-C4. The resistors R1-R11 fulfill the voltage dividing function for direct current and low frequencies, while the capacitors C1-C4 perform the same voltage dividing function for high frequencies.

The compensated voltage divider 120 of the apparatus 100 is not actually composed of discrete resistors and capacitors, but utilizes the supporting structure of the cascade to fulfill the same function. As shown for example in FIG. 1, the apparatus 100 is in the form of a stack, with the transformers 111, 112, 113, 114 positioned on top of each other. Conducting discs 121, 122, 123, 124, 125 are inserted into the stack in an alternating pattern with the transformers 111, 112, 113, 114 between them. The diameter of the conducting discs 121-125 is slightly larger than the diameter of the toroids. In the preferred embodiment of the apparatus having four transformers 111, 112, 113, 114, there are five of conducting discs 121-125. One disc 121 is positioned outside the first transformer 111 at one end of the stack and another disc 125 is positioned outside the last transformer 114 at the opposite end of the stack. Three conducting discs 122, 123, 124 are positioned in between the four transformers 111, 112, 113, 114. The conducting discs 121-125 are preferably made from aluminum or another electrical conducting material.

When the apparatus 100 is placed in an oil insulating medium, the oil between the discs 121-125 comprises a portion of the resistive part of the voltage divider 120. The oil insulating medium used in the apparatus 100 can be a transformer oil that is known in the art, including for example Shell Diala oil.

The discs 121-125 and space between the discs 121-125 comprise the capacitive part of the voltage divider 120. For example, capacitor C1 is formed between discs 124 and 125, capacitor C2 is formed between discs 123 and 124, capacitor C3 is formed between discs 122 and 123, and capacitor C4 is formed between discs 121 and 122. The windings of the transformers 111, 112, 113, 114 also have some small amount of stray capacitance to themselves and to the discs 121-125, which is in parallel with the main capacitance between the discs 121-125. The oil, while generally thought of as an insulator, is actually a very high resistivity conductor. Because the geometry of each of the four stages is identical, the capacitances and resistances of each stage are virtually identical. This fulfills the requirement for a compensated divider.

The apparatus 100 may additionally include an upper end cap 131 at one end of the apparatus 100, adjacent to a conducting disc 121, and a lower end cap 132 at the opposite end of the apparatus 100, adjacent to a conducting disc 125. Spacers 133 may be provided in between the end cap 131 and the conducting disc 121, and in between the end cap 132 and conducting disc 125. The transformers 111, 112, 113, 114 may comprise a plurality of mounting discs 135, to which the ferrite cores 111*c*, 112*c*, 113*c*, 114*c* are mounted. The mounting discs 135 may be secured to the conducting discs 121-125 by inserting screws 134 through aligned openings in the mounting discs 135 and conducting discs 121-125, which may be threaded. The spacers 133 and screws 134 are preferably made from nylon or another insulating material.

The apparatus 100 further comprises a resistive shroud 130, such as a nylon tube or other plastic cylinder with thick walls, which is placed around the transformer set 110. The shroud 130 avoids the possibility of the apparatus 100 structure free standing in oil being subject to external disrupting influences which could compromise the insulation integrity. The cylindrical shroud 130 is also a very high resistivity conductor, and thus is in parallel with the oil resistance inside the cylinder as shown in FIG. 2, aiding in its low frequency and direct current dividing function. The thickness of the shroud 130 shields the internal structure from external fields, greatly adding to the insulation reliability. In an embodiment of the invention, the height $H_1$ of the apparatus 100, including the shroud 130, may be approximately one foot or more.

Figure 2:
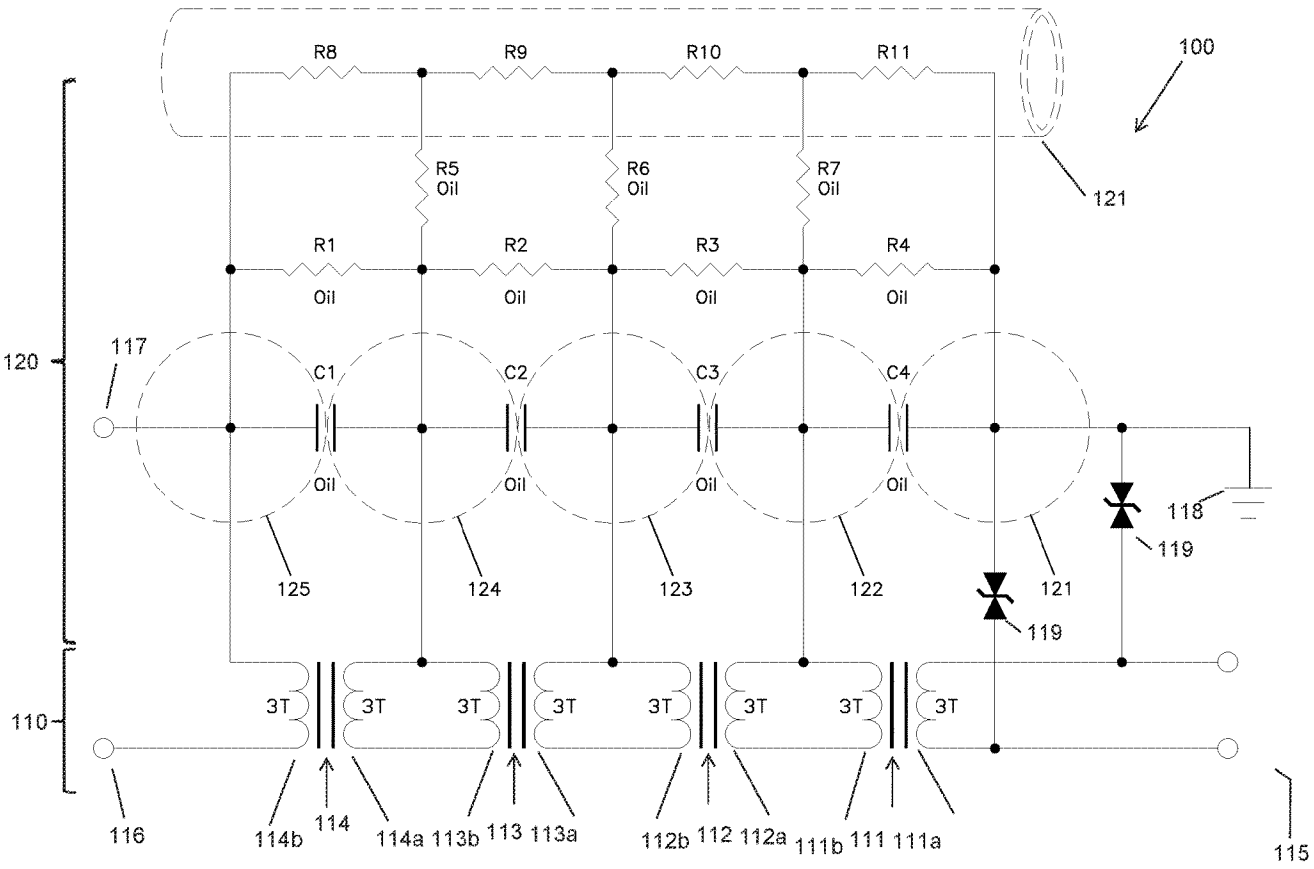
FIG. 2 shows a circuit diagram of an embodiment of the apparatus of the present invention.
Figure 3:
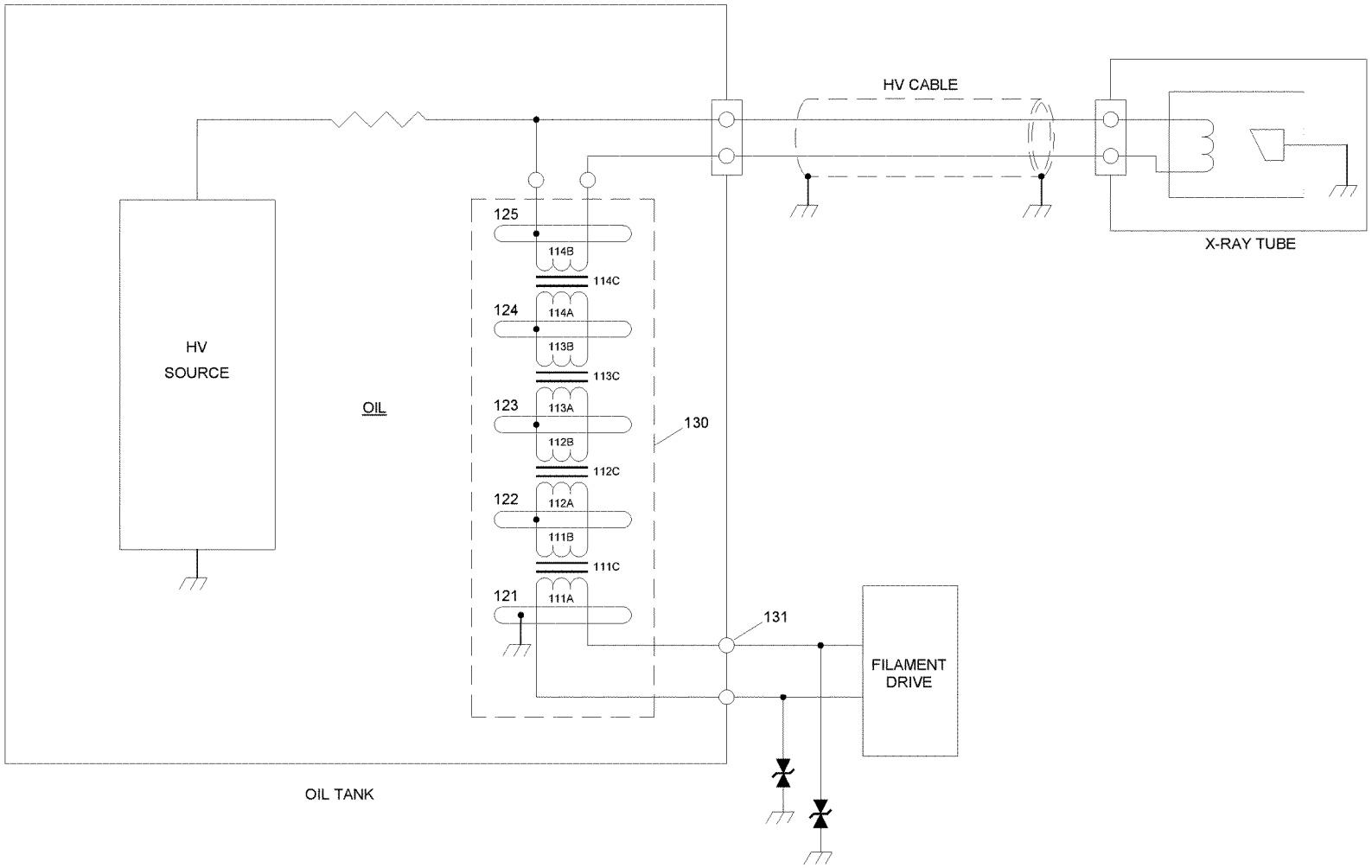
FIG. 3 shows a further diagram of an embodiment of the apparatus of the present invention.

As shown for example in FIG. 2, an input drive 115 is connected to the primary winding 111*a* of the first transformer 111 in the cascaded transformer set 110. The secondary winding 114*b* of the last transformer 114 in the cascaded transformer set 110 is connected to a filament output drive 116 and a common terminal 117, which has a potential of 180 kV. Additionally, a ground source 118 is connected to one or more transient voltage suppression (TVS) diodes 119. The TVS diodes 119 are connected to the primary winding 111*a* of the first transformer 111, and protect the apparatus 100 from voltage spikes.

It should be understood that, unless stated otherwise herein, any of the features, characteristics, alternatives or modifications described regarding a particular embodiment herein may also be applied, used, or incorporated with any other embodiment described herein. Additionally, the drawings herein may not be drawn to scale in whole or in part.

Although the invention has been described and illustrated with respect to exemplary embodiments thereof, the foregoing and various other additions and omissions may be made therein and thereto without departing from the spirit and scope of the present invention.

What is claimed:

1. An apparatus comprising:

a cascaded transformer set comprising a plurality of transformers, each transformer having a primary and a secondary winding, and each transformer comprising three insulating gaps, wherein in the cascaded transformer set, the secondary winding of one transformer feeds the primary winding of an adjacent transformer; and a voltage divider comprising a plurality of capacitors, each of equal value, and a plurality of resistors configured to evenly divide a voltage applied to the cascaded transformer set among the insulating gaps of the cascaded transformer set;

wherein the plurality of capacitors comprises a plurality of discs, wherein each capacitor of the plurality of capacitors is formed between two discs of the plurality of discs, wherein the apparatus further comprises an oil medium surrounding the plurality of transformers and the plurality of discs, and wherein the plurality of discs and plurality of transformers are arranged such that each of the plurality of transformers is positioned between two of the plurality of discs.

2. The apparatus of claim 1, wherein the plurality of transformers comprises four transformers and the plurality of discs comprises five discs.

3. The apparatus of claim 2, wherein each transformer of the plurality of transformers is a toroidal transformer comprising a ferrite core with the primary windings and secondary windings around opposing sides of the ferrite core.

4. The apparatus of claim 3, wherein the primary and secondary winding of each of the plurality of transformers is a three turn winding around the ferrite core.

5. The apparatus of claim 4, wherein the primary winding and the secondary winding of each of the plurality of transformers comprises a high voltage insulated wire.

6. The apparatus of claim 5, wherein each of the plurality of transformers comprises three insulating gaps in the form of insulation of the high voltage insulated wire of the primary winding, insulation of the high voltage insulated wire of the secondary winding and a physical space between the primary winding and secondary winding.

7. The apparatus of claim 5, wherein the plurality of transformers and the plurality of discs are arranged parallel to each other in a stack, wherein the stack alternates between one of the plurality of discs and one of the plurality of transformers, such that each of the plurality of transformers is positioned in between two of the plurality of discs.

8. The apparatus of claim 7, wherein the cascaded transformer set is connected to an input drive at a first end and a filament output drive and a common terminal at second end opposing the first end.

9. The apparatus of claim 8, wherein the input drive is connected to a primary winding of a first transformer, a secondary winding of the first transformer feeds into a primary winding of a second transformer, a secondary winding of the second transformer feeds into a primary winding of a third transformer, a secondary winding of the third transformer feeds into a primary winding of a fourth transformer, and the fourth transformer is connected to the filament output drive and the common terminal.

10. The apparatus of claim 1, wherein the apparatus provides power to an X-ray tube filament.

11. The apparatus of claim 1, wherein each of the plurality of discs is made from aluminum.

12. The apparatus of claim 1, wherein the plurality of resistors comprises a plurality of equal value resistors formed by the oil medium in between adjacent pairs of discs.

13. The apparatus of claim 1, wherein the device comprises a plurality of stages, each stage comprising a toroid between two conducting discs in the oil medium, wherein the geometry of each of the plurality of stages is identical.

14. The apparatus of claim 13, wherein the device consists of four stages having a total of four toroids and five conducting discs.

15. An apparatus comprising:

a cascaded transformer set comprising a plurality of transformers, each transformer having a primary and a secondary winding, and each transformer comprising three insulating gaps, wherein in the cascaded transformer set, the secondary winding of one transformer feeds the primary winding of an adjacent transformer;

a voltage divider comprising a plurality of capacitors, each of equal value, and a plurality of resistors, configured to evenly divide a voltage applied to the cascaded transformer set among the insulating gaps of the cascaded transformer set, wherein the plurality of capacitors comprises a plurality of discs, wherein the plurality of discs and plurality of transformers are arranged such that each of the plurality of transformers is positioned between two of the plurality of discs; and a resistive shroud around the cascaded transformer set and the plurality of discs, wherein the resistive shroud forms at least a part of the plurality of resistors of the voltage divider.

16. The apparatus of claim 15, wherein the resistive shroud is a nylon tube around the cascaded transformer set and the plurality of discs.

17. The apparatus of claim 15, further comprising an oil medium surrounding the plurality of transformers and the plurality of discs and in between the plurality of discs and the resistive shroud.

18. The apparatus of claim 17, wherein the plurality of resistors comprises:

a first plurality of resistors provided by the oil medium surrounding the plurality of transformers and the plurality of discs, a second plurality of resistors provided by the oil medium in between the plurality of discs and the resistive shroud, and a third plurality of resistors provided by the resistive shroud.

* * * * *